US009853386B1

(12) United States Patent
Lee et al.

(10) Patent No.: US 9,853,386 B1
(45) Date of Patent: Dec. 26, 2017

(54) MODULE CONNECTION MECHANISM CAPABLE OF GENDERLESS COUPLING

(71) Applicant: Korea Institute of Science and Technology, Seoul (KR)

(72) Inventors: Woosub Lee, Seoul (KR); Seonghun Hong, Seoul (KR); Sung Chul Kang, Seoul (KR); Kang Gyun Kim, Seoul (KR)

(73) Assignee: Korea Institute of Science and Technology, Seoul (KR)

( * ) Notice: Subject to any disclaimer, the term of this patent is extended or adjusted under 35 U.S.C. 154(b) by 0 days.

(21) Appl. No.: 15/474,672

(22) Filed: Mar. 30, 2017

(30) Foreign Application Priority Data

Jun. 23, 2016 (KR) ..... 10-2016-0078523

(51) Int. Cl.
*H01R 13/28* (2006.01)
*H01R 13/24* (2006.01)
*H01R 13/622* (2006.01)

(52) U.S. Cl.
CPC ..... *H01R 13/2421* (2013.01); *H01R 13/622* (2013.01)

(58) Field of Classification Search
CPC ..... H01R 13/28; H01R 23/27; H01R 24/84
USPC ..... 439/294, 314, 316, 289, 700, 680
See application file for complete search history.

(56) References Cited

U.S. PATENT DOCUMENTS 3,252,124 A * 5/1966 Hansen ..... H01R 23/27 439/291
6,605,914 B2 8/2003 Yim et al.
9,004,930 B2 * 4/2015 Gualino ..... H01R 13/2421 439/136
9,597,803 B2 3/2017 Mimura et al.
2013/0340560 A1 12/2013 Burridge et al.

FOREIGN PATENT DOCUMENTS

JP 2014-34075 A 2/2014
KR 10-1280237 B1 7/2013
KR 10-2015-0007033 A 1/2015

OTHER PUBLICATIONS

Andreas Lyder, et al., "Genderless Connection Mechanism for Modular Robots Introducing Torque Transmission Between Modules," *Proceedings of the IEEE 2010 International Conference on Robotics and Automation workshop*, May 2010, Alaska, USA, pp. 77-81 (9 pages in English).

Christopher Parrott, et al., "HiGen: A High-Speed Genderless Mechanical Connections Mechanism with Single-Sided Disconnect for Self-Reconfigurable Modular Robtos," *Proceedings of the IEEE/RSJ International Conference on Intelligent Robots and Systems*, (IROS 2014), Sep. 2014, Chicago, IL, USA, pp. 3926-3932.

* cited by examiner

*Primary Examiner* — Phuong Dinh
(74) *Attorney, Agent, or Firm* — NSIP Law

(57) ABSTRACT

A module connection mechanism for coupling adjacent modules, has a connector for connecting the modules. The connector has a substrate having a plurality of terminals for transmitting power and signals, installed between the modules, a fixing body disposed to surround the substrate and having a fixing wing with a wing thread formed at an outer surface thereof, and a fixing ring disposed to surround the fixing body and having a ring thread formed at an inner surface thereof, so that the ring thread moves to cover an outer surface of the fixing body.

10 Claims, 10 Drawing Sheets

MODULE CONNECTION MECHANISM CAPABLE OF GENDERLESS COUPLING

CROSS-REFERENCE TO RELATED APPLICATION

This application claims priority to Korean Patent Application No. 10-2016-0078523, filed on Jun. 23, 2016, and all the benefits accruing therefrom under 35 U.S.C. §119, the contents of which in its entirety are herein incorporated by reference.

BACKGROUND

1. Field

The present disclosure relates to a module connection mechanism capable of being used for a product such as a robot composed of a plurality of modules, and more particularly, to a module connection mechanism capable of genderless coupling, which may electrically or mechanically couple the modules without male and female classification.

DESCRIPTION ABOUT NATIONAL RESEARCH AND DEVELOPMENT SUPPORT

This study was supported by the Robot Industry Fusion Core Technology Development project of Ministry of Trade, Industry and Energy, Republic of Korea (Project No. 1415141566) under the superintendence of Korea Evaluation Institute of Industrial Technology.

2. Description of the Related Art

A robot is a machine capable of processing a part of functions of a human or performing certain works by itself. Recently, industrial robots and medical robots having various functions and complicated structures are being developed.

In the existing technique, a robot is fabricated so that a body performing computational processing and a driving unit having a motor or an actuator are integrated. If the body and the driving unit are not integrally fabricated, the body and the driving unit are generally coupled by means of a coupling member such as bolts or screws so as not to be easily dissembled.

However, in consideration of each repair and exchange of parts of the robot, recently, a modular robot where a driving unit is easily mounted to and dissembled from a body is being commercially used. For example, a robot may be completely fabricated by coupling and assembling a plurality of modules which take charge of functions of a body and a driving unit. For normally operating the modular robot, the modules should be coupled to each other both structurally and electrically. Here, the structural coupling means that two components are mechanically coupled into a single unit, and the electric coupling means that wires for power supply, communication and control are connected to each other.

In order to for the modules to be connected structurally and electrically as described above, connectors serving as connection members between modules are required between the modules. In other words, the easiness of assembling and dissembling of modules of a robot and the completeness of structural or electrical coupling between modules are greatly influenced by the kind and function of the connector. Therefore, in the existing modular robot field, the connector is being actively studied.

For example, U.S. Pat. No. 6,605,914 discloses a pivot mechanism for mechanically and electrically connecting modules. The pivot mechanisms are individually installed at adjacent modules, and the pivot mechanisms are coupled to each other to combine the modules. The pivot mechanism of this document has no male and female classification and thus allow genderless coupling with each other, and also the pivot mechanisms may be coupled to each other at eight initial locations in total.

However, the pivot mechanism includes terminals arranged in a concentric ring shape, and thus if a bending force is applied to their coupled portion, their electric connection may become unstable due to a bad contact between the terminals. In addition, since a power source is embedded inside a module in a battery form and the number of terminals for transmitting signals between modules is limited, electric genderless coupling is not perfectly implemented.

As another example, US unexamined patent publication US2013/0340560 discloses a coupling member for mechanically and electrically connecting modules. The coupling member includes a circular PCB interface for electrically connecting modules and a mechanical coupling for structurally connecting modules.

However, the coupling members are classified into male and female members, and thus their orientations should be considered to coupling and assembling the coupling members to each other, which greatly deteriorates easiness in assembling and also seriously increases the possibility of errors. In addition, when the coupling members are connected to each other, only two initial coupling locations may be selected at an interval of 180°, and thus there is a limit in the degree of coupling freedom between modules.

SUMMARY

The present disclosure is directed to providing a module connection mechanism capable of genderless coupling, which may electrically or mechanically couple modules without male and female classification, allow the transfer of high voltage and high current between the modules, and also allow the transfer of various signals.

In one aspect, there is provided a module connection mechanism for coupling adjacent modules, comprising a connector for connecting the modules. The connector includes: a substrate having a plurality of terminals for transmitting power and signals, installed between the modules; a fixing body disposed to surround the substrate and having a fixing wing with a wing thread formed at an outer surface thereof; and a fixing ring disposed to surround the fixing body and having a ring thread formed at an inner surface thereof, so that the ring thread moves to cover an outer surface of the fixing body.

The fixing wing may include: a first part attached to the fixing body; and a second part having an outer surface at which the wing thread is formed.

The module connection mechanism may include: a first connector fixed to one side of a first module; and a second connector having the same configuration as the first connector and fixed to one side of a second module.

The first connector and the second connector may be secondarily coupled to each other by coupling a ring thread of the first connector to a wing thread of the second connector by means of rotation and coupling a ring thread of the second connector to a wing thread of the first connector by means of rotation.

A power supplier, a signal transmitter and a ground may be provided at the substrate in order from a center thereof to an outer side.

Terminals for transmitting signals to the power supplier, the signal transmitter and the ground and spring pins having a predetermined elastic force may be installed at the substrate in a fan shape.

The terminals may configure a terminal group concentrated in a fan shape of 45°, the terminal group is provided in plural inside the substrate, and the number of terminals belonging to a signal transmitter among any one terminal group may be 7 or above.

Among the terminals and the spring pins, spring pins other than a positioning pin for detecting an initial coupling location may be disposed to be symmetric based on a single point on the substrate.

The positioning pin may include a first positioning pin disposed relatively at an outer side of the ground and a second positioning pin disposed opposite to the first positioning pin based on a single point and disposed relatively at an inner side of the ground in comparison to the first positioning pin, and initial coupling locations of the first connector and the second connector may be detectable at intervals of 90° by means of the first positioning pin and the second positioning pin.

A recess having an inwardly concave shape may be formed at an outer surface of the fixing ring.

According to an embodiment of the present disclosure, since connectors for connecting adjacent modules may be coupled genderless without male and female classification, the modules may be coupled with each other very easily.

In addition, since terminals for transmitting signals between modules are disposed at the connector in a fan shape, a large number of connection terminals may be installed in a single set and various signals may be transmitted.

Moreover, since a positioning pin capable of detecting four or more initial coupling locations at an interval of 90° is installed on the substrate when the connectors are coupled to each other, it is possible to ensure stable coupling between the modules.

DETAILED DESCRIPTION

Figure 1:
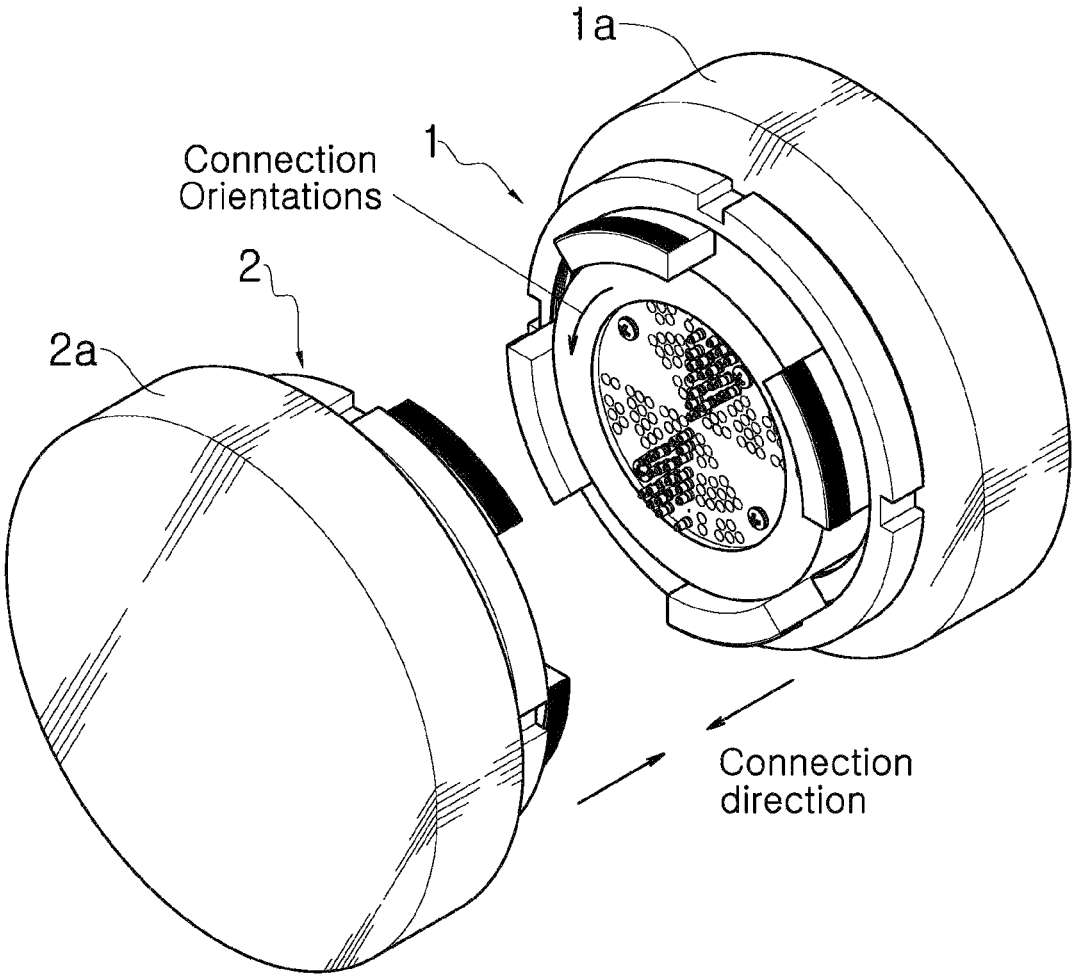
FIG. 1 is a perspective view showing a relation of a module and a connector according to an embodiment of the present disclosure.

Hereinafter, an embodiment of the present disclosure will be described with reference to the drawings. Even though the present disclosure is described based on the embodiment depicted in the drawings, this is just an example, and the essential configuration and operations of the present disclosure are not limited thereto.

FIG. 1 is a perspective view showing a relation of a module and a connector according to an embodiment of the present disclosure.

Referring to FIG. 1, a connector (a module connection mechanism) according to the present disclosure includes a first connector 1 fixedly coupled to a first module 1*a* and a second connector 2 fixedly coupled to a second module 2*a*. In detail, the first module 1*a* is disposed adjacent to the second module 2*a*, and the first module 1*a* and the second module 2*a* may be coupled by means of coupling of the first connector 1 and the second connector 2.

This module may be used in various fields such as robots and modular toys which are fabricated in an assembling manner. For example, the first module 1*a* may be a lower portion of a robot arm, and the second module 2*a* may be an upper portion of the robot arm. In addition, the first connector 1 and the second connector 2 may take charge of an intermediate joint portion of the robot. In this case, the first connector 1 and the second connector 2 need to be electrically connected and structurally coupled so as to ensure electric and mechanic connection between the first module 1*a* and the second module 2*a*.

Hereinafter, in the electric and mechanic connection, the process of electrically connecting the first connector 1 and the second connector 2 will be described.

Figure 2:
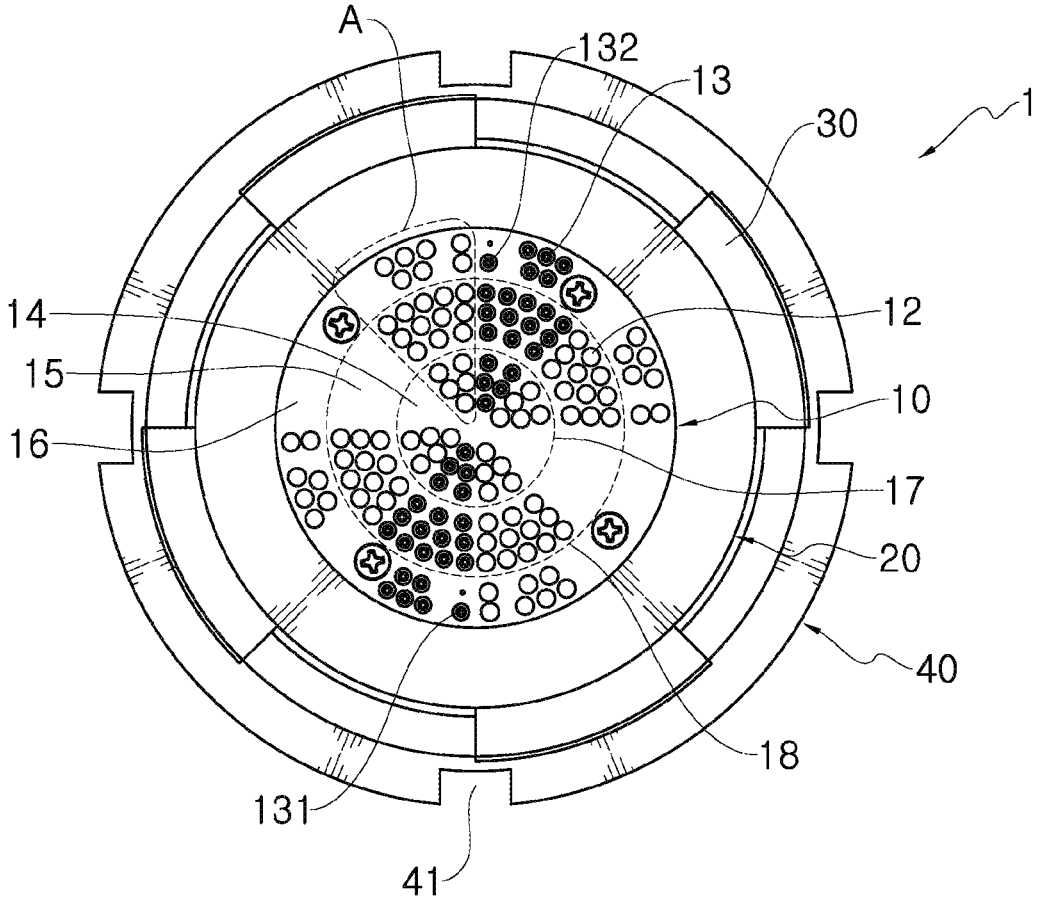
FIG. 2 is a front view showing a structure of a first connector of the connector, which is fixed to a first module.
Figure 3:
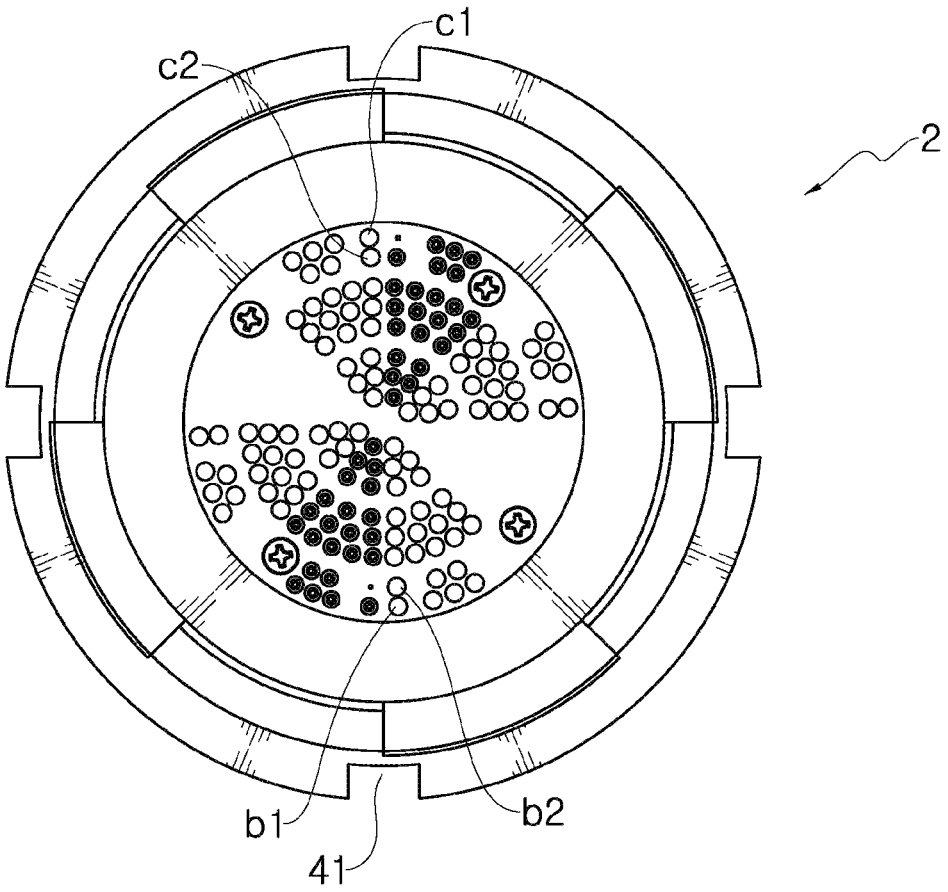
FIG. 3 is a front view showing a structure of a second connector of the connector, which is fixed to a second module.

FIG. 2 is a front view showing a structure of a first connector of the connector, which is fixed to a first module, and FIG. 3 is a front view showing a structure of a second connector of the connector, which is fixed to a second module.

First, referring to FIG. 2, the first connector 1 includes a substrate 10 at which a plurality of terminals for transmitting signals between the first module 1*a* and the second module 2*a* are installed. The substrate 10 may be, for example, a printed circuit board (PCB). In addition, a fixing body 20 and a fixing ring 40 are disposed in order at an outer surface of the substrate 10. In other words, the fixing body 20 is disposed to surround the substrate 10, and the fixing ring 40 is disposed to surround the fixing body 20. The fixing ring 40 is a locking ring having a thread at an inside thereof, and the fixing body 20 has a fixing wing 30 with a thread at an outer side thereof to be screwed with the fixing ring 40.

A power supplier 14, a signal transmitter 15 and a ground 16 are provided in order at the substrate 10 from a center thereof to an outer side. In detail, the power supplier 14 is configured to supply power to at least one of the modules 1*a*, 2*a*, the signal transmitter 15 is configured to transmit a specific signal generated by the voltage between the modules 1*a*, 2*a*, and the ground 16 is configured to maintain a potential of a device to 0 (zero). In other words, since the power supplier 14, the signal transmitter 15 and the ground 16 are provided at the substrate 10 installed at the first connector 1, it is possible to electrically couple the modules 1*a*, 2*a*.

In FIG. 2, an inner boundary line 17 is depicted between the power supplier 14 and the signal transmitter 15, and an outer boundary line 18 is depicted between the signal transmitter 15 and the ground 16. However, the inner boundary line 17 and the outer boundary line 18 are imaginary lines for classifying regions with different functions, and in an actual product, these components may be disposed to be spaced apart from each other so that the regions of the power supplier 14 and the signal transmitter 15 or the regions of the signal transmitter 15 and the ground 16 may be distinguished from each other.

In addition, terminals 12 for transmitting signals and spring pins 13 having a predetermined elastic force are installed at the substrate 10 in a fan shape, respectively. The terminals 12 and the spring pins 13 may be installed at the power supplier 14, the signal transmitter 15 and the ground 16.

The terminals 12 configure a terminal group A in which the terminals are concentrated in a fan shape of 45°. In other words, the terminals 12 configure one set of terminal group A in a region of a fan shape of 45 over the power supplier 14, the signal transmitter 15 and the ground 16. In addition, plural sets of the terminal groups A are installed in the substrate, and the terminals 12 belonging to the terminal group A are arranged symmetric based on a single point on the substrate 10. In addition, the terminals 12 arranged symmetric based on a single point on the substrate 10 are electrically connected to each other. As an example of the arrangement of the terminals 12 disposed on the substrate 10, as shown in FIG. 2, the terminal group A where the terminals 12 are concentrated may be disposed to occupy four regions among eight regions divided by 45° on the substrate 10. In addition, the terminal groups A may be disposed to be spaced apart from each other by a predetermined distance. According to the present disclosure, as the terminals 12 are concentrated with each other to configure a plurality of terminal groups A, the amount of signals transmitted between the modules 1*a*, 2*a* may be increased.

In addition, since the terminals 12 are disposed symmetric based on a single point, even though a bending force is applied to the connectors 1, 2 as an example, the connectors 1, 2 may be electrically connected in a stable way. For example, if a bending force is applied to a portion of the first connector 1 so that a tensile force of a predetermined intensity is applied to any terminal of the first connector 1, a compressive force of the same intensity as the force applied to the terminal is applied to another terminal disposed symmetric thereto based on the single point. As described above, the terminals 12 disposed at portions symmetric based on the single point on the substrate 10 are electrically connected. In other words, the above two terminals receive a tensile force and a compressive force, respectively, in an electrically connected state, and thus it is possible to effectively cope with the bending force applied to the connectors 1, 2.

As another configuration installed on the substrate 10, the spring pins 13 having a predetermined elastic force are installed between the terminal groups A. The spring pins 13 may be, for example, disposed to occupy two regions among four regions between the terminal groups A, as shown in FIG. 2. In addition, the spring pins 13 may be disposed to have a fan shape of 45°, similar to the terminals 12. In addition, among the spring pin 13, spring pins other with a positioning pin for detecting an initial coupling location may be disposed symmetric based on a single point on the substrate 10.

In detail, the spring pins 13 may configure two sets of spring pin groups symmetric based on a single point, respectively. In other words, each set of spring pin groups may include a plurality of spring pins 13 formed over the power supplier 14, the signal transmitter 15 and the ground 16. Here, pins are disposed in plural sets symmetric based on the single point in order to ensure strong electric connection even though a bending force is applied in any direction.

Based on one set of spring pin group among the plurality of spring pin groups, the number of pins disposed at the power supplier 14 is 5, and the number of pins disposed at the signal transmitter 15 is 12. In addition, the number of pins disposed at the ground 16 is 5, and a single positioning pin is additionally disposed thereat. In other words, since 23 pins are disposed at one set of spring pin group, 46 pins are disposed on the substrate 10 in total. In the existing technique, the number of all pins including pins for power and signals is just 6, but in the present disclosure, 46 pins are disposed in total, which allows various signals to be transmitted.

However, the positioning pins are not disposed to be symmetric based on the single point on the substrate 10. In detail, the positioning pins include a first positioning pin 131 disposed relatively at an outer side of the ground 16 and a second positioning pin 132 disposed opposite to the first positioning pin 131 based on the single point and disposed relatively at an inner side of the ground 16 in comparison to the first positioning pin 131. In other words, since a spring pin is not disposed at portions symmetric to the first positioning pin 131 and the second positioning pin 132 based on the single point, initial coupling locations of the first connector 1 and the second connector 2 may be detected therefrom. In detail, by using the positioning pins 131, 132, a user may detect initial coupling locations of the first connector 1 and the second connector 2 at intervals of 90°. This will be described below in more detail with reference to FIG. 3.

FIG. 3 is a front view showing a structure of a second connector of the connector, which is connected to a second module.

The second connector 2 according to the present disclosure has substantially the same configuration as the first connector 1 as a whole and thus is not described in detail here. In other words, the first connector 1 and the second connector 2 are coupled to each other in a state of facing each other, and thus a coupling surface of the second connector 2 and a coupling surface of the first connector 1 are identical to each other in view of detail configurations and arrangements.

If the first connector 1 and the second connector 2 are coupled to each other, the coupling surface of the first connector 1 depicted in FIG. 2 will overlap with the coupling surface of the second connector 2 depicted in FIG. 3. At this time, the first positioning pin 131 of the first connector 1 will overlap with a terminal b1 of the second connector 2, and there is no component overlapping with a terminal b2. Similarly, the second positioning pin 132 of the first connector 1 will overlap with a terminal c2 of the second connector 2, and there is no component overlapping with a terminal c1. Moreover, the first positioning pin 131 may be electrically connected to the second positioning pin 132, the terminal b1 may be electrically connected to the terminal c2, and the terminal b2 may be electrically connected to the terminal c1. Accordingly, the initial coupling locations of the first connector 1 and the second connector 2 may be checked.

In addition, when the first connector 1 and the second connector 2 are coupled, the terminal of the first connector 1 should not overlap with the terminal of the second connector 2. In other words, if terminals of connectors transmitting different signals are overlapped, a signal transmission error such as a current leakage or a short circuit may occur. Considering the above, the first connector 1 and the second connector 2 may be initially coupled at an interval of 90°. In other words, terminals of connectors may be disposed without overlapping with each other only when a coupling location of the first connector 1 with respect to the second connector 2 forms 0°, 90°, 180° or 270°. In other words, the initial coupling locations of the first connector 1 and the second connector 2 may be detected at four locations in total by means of the first positioning pin 131 and the second positioning pin 132.

Hereinafter, the electric coupling between the first connector 1 and the second connector 2 will be described. However, since the first connector 1 and the second connector 2 have the same configuration, in this specification, only the first connector 1 will be described. In addition, for convenience, among components at the first connectors 1, only the power supplier 14 will be described. However, it should be understood that the following description can also be applied to the signal transmitter 15 and the ground 16 identically.

Figure 4A:
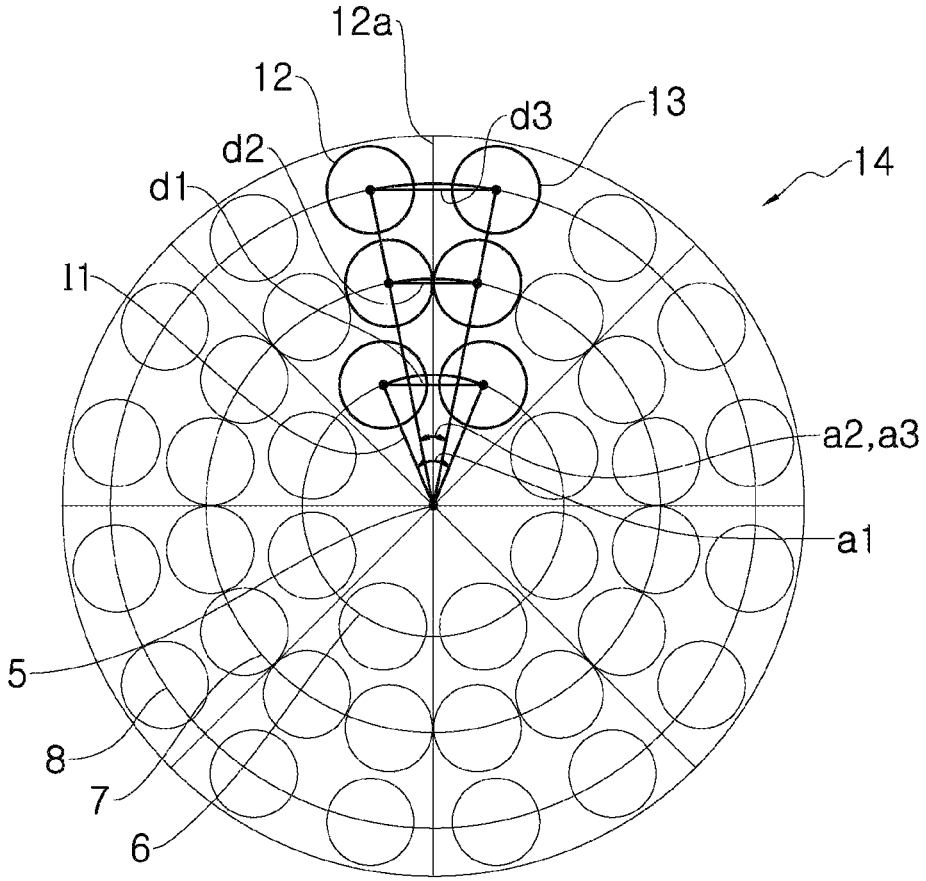
FIG. 4A is a diagram showing a power supplier of the connector.
Figure 4B:
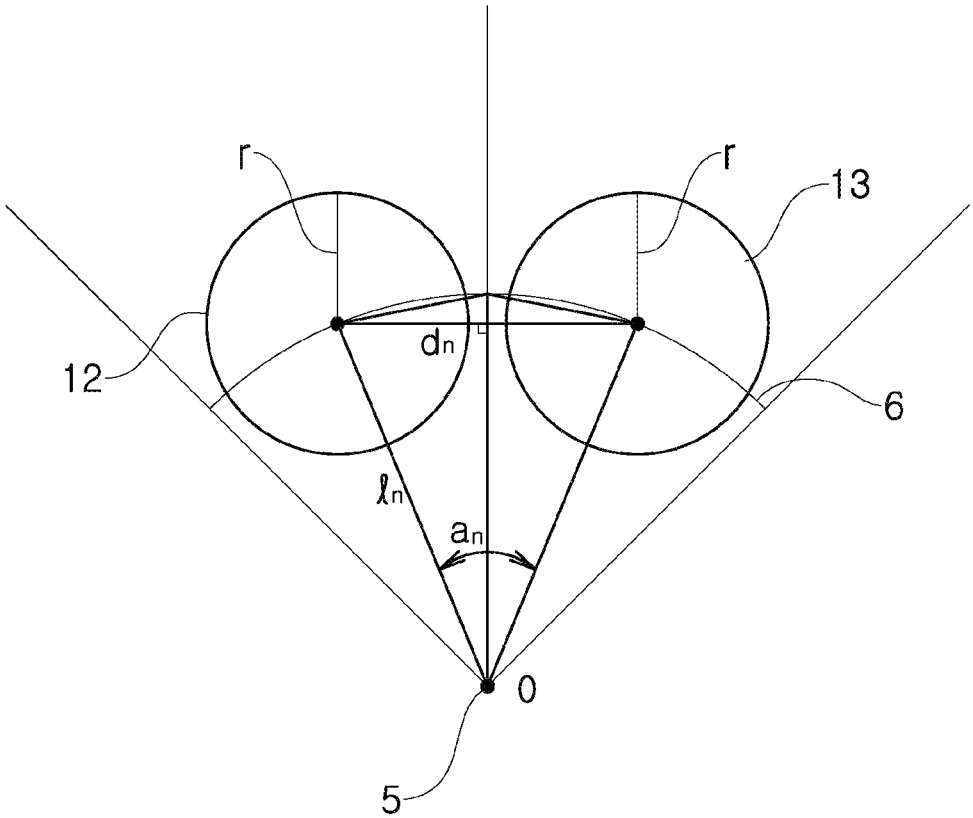
FIG. 4B is a diagram for illustrating an electrical connection method of the connector.

FIG. 4A is a diagram showing a power supplier of the connector, and FIG. 4B is a diagram for illustrating an electrical connection method of the connector.

Referring to the figures, at the power supplier 14 of the first connector 1, a plurality of terminal groups respectively having five terminals 12 and a plurality of spring pin groups respectively having five spring pins 13 are installed symmetric based on a single point.

Among the plurality of terminal groups and spring pin groups, adjacent terminal groups and spring pin groups are disposed symmetric to each other based on a boundary line 12*a*. In addition, the terminals 12 and the spring pins 13 are arranged along three rows 6, 7, 8 in a direction departing from a center 5 of the power supplier 14. In detail, based on a single terminal group and a single spring pin group adjacent to each other, a single terminal and a single spring pin group are disposed at the first row 6, and two terminals and two spring pin groups are disposed at the second row 7 and the third row 8. The first to third rows 6, 7, 8 may be concentric circles whose center is identical to the center 5 of the power supplier 14.

In order to improve functions of the connectors and exchange more signals, it is desirable to arrange terminals 12 and spring pins 13 at the power supplier 14 as more as possible. However, in order to prevent the terminals 12 and the spring pins 13 from overlapping with each other, a minimum distance from the center 5 of the power supplier to the terminals 12 and the spring pins 13 should be regulated in consideration of conditions such as sizes of the terminals 12 and the spring pins 13 or distances between the terminals 12 and the spring pins 13.

In detail, a distance (dn) between the center of the terminal 12 and the center of the spring pin 13 should be greater than a sum of a radium of the terminal 12 and a radius of the spring pin 13. The terminal 12 and the spring pin 13 have the same radius (r). Therefore, dn should be greater than 2r.

dn can be calculated using the following equation.

$$dn=2ln*\sin(\alpha n/2) \quad \text{[Equation 1]}$$

In the above equation, ln represents a distance from the center of the terminal 12 (or the center of the spring pin 13) to the center 5 of the power supplier 14, αn represents an angle between an imaginary line connecting the center of the terminal 12 and the center 5 of the power supplier 14 and an imaginary line connecting the center of spring pin 13 and the center 5 of the power supplier 14. In addition, n represents a location of a row where the terminal belongs to.

Here, r is a given value. Therefore, a minimum value of ln can be calculated according to an. In addition, a worker can determine actual ln and dn based on the minimum value of ln. Accordingly, the terminals 12 and the spring pins 13 may be disposed at the power supplier 14 as more as possible so that the terminals 12 and the spring pins 13 do not overlap with each other. Hereinafter, the structural coupling of the first connector 1 and the second connector 2 will be described.

Figure 5A:
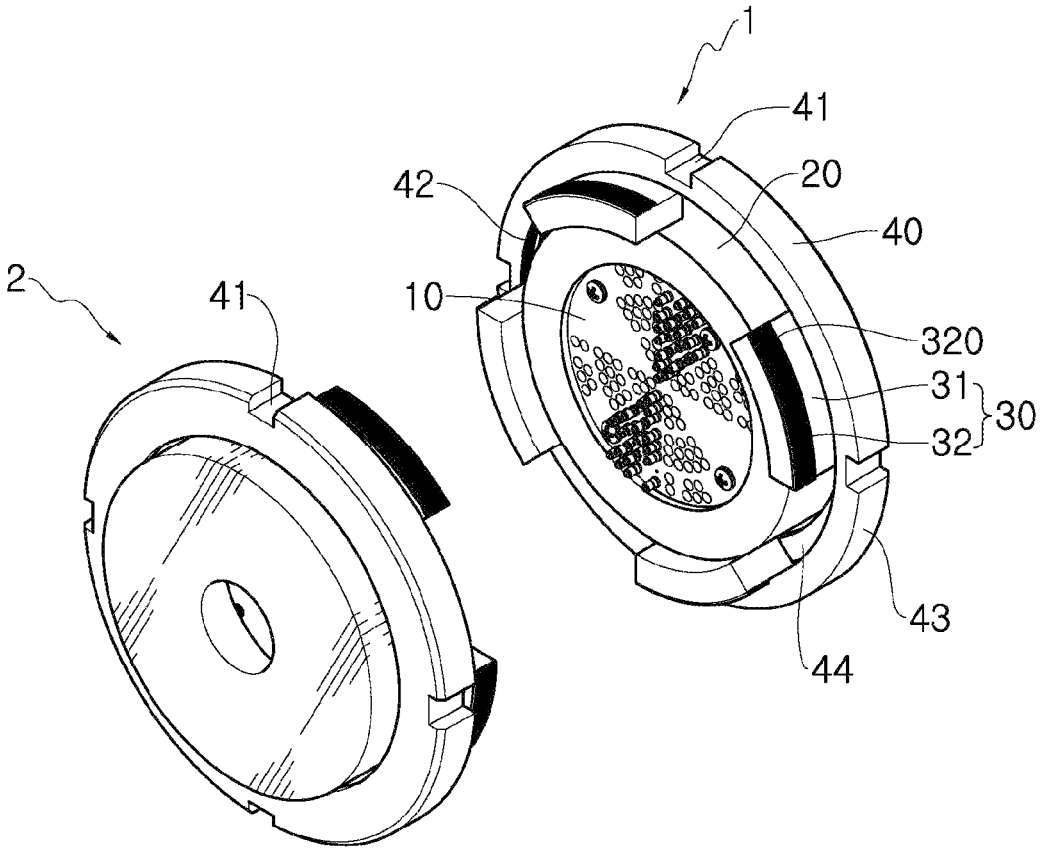
FIG. 5A is a perspective view showing a state before the first connector and the second connector are coupled.
Figure 5B:
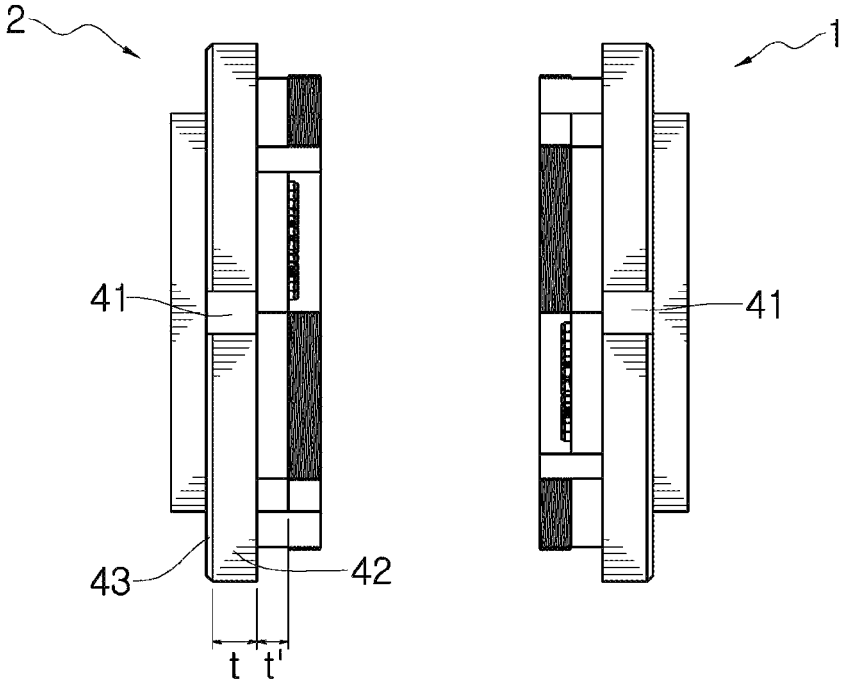
FIG. 5B is a side view of FIG. 5A.
Figure 6A:
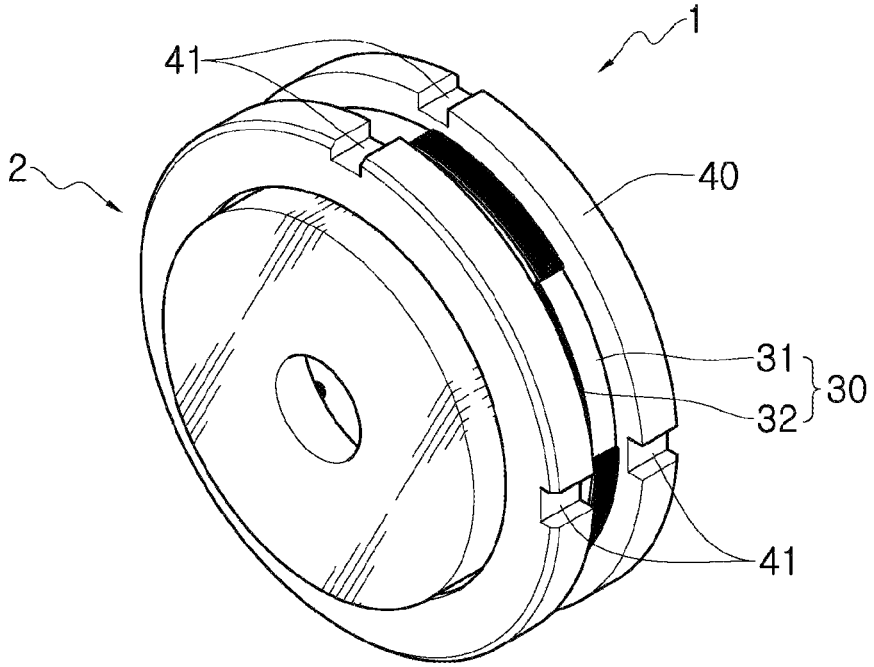
FIG. 6A is a perspective view showing a primary coupling state of the first connector and the second connector.
Figure 6B:
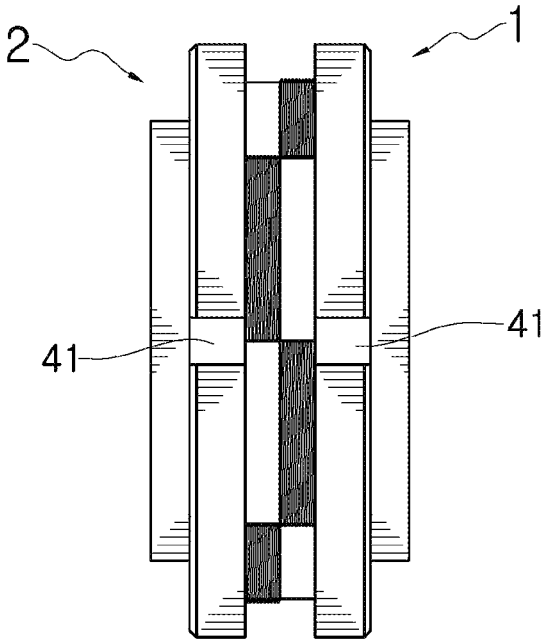
FIG. 6B is a side view of FIG. 6A.
Figure 7A:
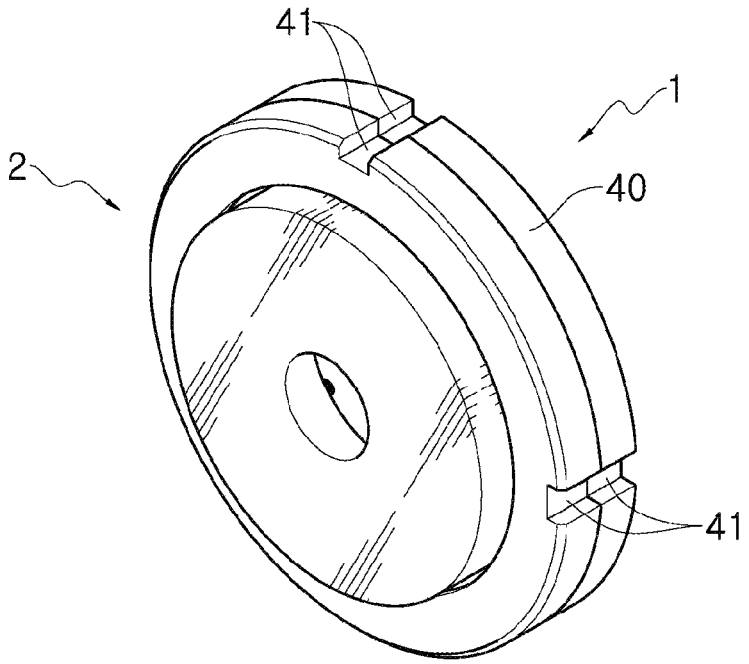
FIG. 7A is a perspective view showing a secondary coupling state of the first connector and the second connector.
Figure 7B:
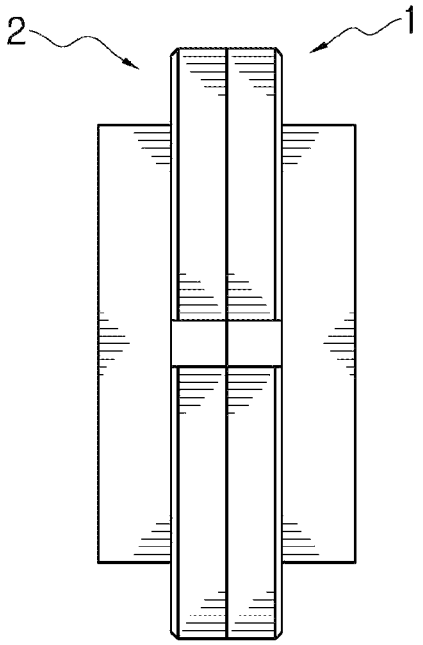
FIG. 7B is a side view of FIG. 7A.

FIGS. 5A and 5B are diagrams showing a state before the first connector and the second connector are coupled, and FIGS. 6A and 6B are diagrams showing a primary coupling state of the first connector and the second connector. Also, FIGS. 7A and 7B are diagrams showing a secondary coupling state of the first connector and the second connector.

Based on the first connector 1, the fixing body 20 includes a fixing wing 30 having a wing thread 320 formed at an outer surface thereof. In detail, the fixing wing 30 is fixedly coupled to the outer surface of the fixing body 20 and disposed between the fixing body 20 and the fixing ring 40. In addition, the fixing wing 30 includes a first part 31 attached to the fixing body 20 and a second part 32 having an outer surface at which the wing thread 320 is formed. The first part 31 is installed at a location relatively closer to the first module 1*a*, and the second part 32 is installed at a location relatively far from the first module 1*a*.

The fixing ring 40 includes a body 43 having a substantially ring shape and a flange 44 extending in an inner diameter direction of the body 43 and leaning toward a rear surface of the body 43 to form a step.

At the outer surface of the body 43 of the fixing ring 40, a recess 41 having an inwardly concave shape is formed. The recess 41 plays a role of a handle for a user to easily rotate the fixing ring of the first connector 1 and the fixing ring of the second connector 2. In other words, a user may grip the recess 41 and firmly couple the fixing ring of the first connector 1 and the fixing ring of the second connector 2 to each other.

In addition, a ring thread 42 engaged with the wing thread 320 formed at the outer surface of the fixing wing 30 is formed at an inner surface of the body 43 of the fixing ring 40. As the ring thread 42 rotates in engagement with the wing thread 320, the fixing ring 40 may move to cover the outer surface of the fixing body 20.

As shown in FIG. 5B, the body 43 of the fixing ring 40 is formed to have substantially the same thickness (t) as the thickness (t') of the first part 31 of the fixing wing 30. When the fixing ring 40 is screwed to the second part of the second connector 2, if the flange 43 comes into contact with the rear surface of the first connector 31, the fixing ring 40 is not able to advance further. In other words, the flange 43 plays a role of stopper for the fixing ring 40.

The second connector 2 has a configuration corresponding to the first connector 1 described above and thus is not described in detail here. Hereinafter, the process of structurally coupling the first connector 1 and the second connector 2 will be described in detail with reference to the figures.

First, a user disposes the first connector 1 fixed to the first module 1*a* and the second connector 2 fixed to the second module 2*a* so that a coupling surface of the first connector 1 and a coupling surface of the second connector 2 face each other (see FIGS. 5A and 5B).

After that, the ring thread of the first connector 1 is coupled to the wing thread of the second connector 2 by means of rotation, and the ring thread of the second connector 2 is coupled to the wing thread of the first connector 1 by means of rotation, thereby coupling the first connector 1 and the second connector 2. In detail, by rotating the fixing ring of the first connector 1 and the fixing ring of the second connector 2 in the same direction, the wing thread 320 formed at the outer surface of the fixing wing 30 of the fixing body 20 of the first connector 1 is coupled to the ring thread formed at the inner surface of the fixing ring of the second connector 2 in a pair-screwing manner. Simultaneously, the wing thread formed at the outer surface of the fixing wing of the fixing body of the second connector 2 is coupled to the ring thread 42 formed at the inner surface of the fixing ring 40 of the first connector 1 in a pair-screwing manner.

Accordingly, by moving the fixing ring of the first connector 1 and the fixing ring of the second connector 2 in approaching directions with each other along the outer surface of each fixing wing, the connectors 1, 2 may be compressed to each other. At this time, due to the elastic force of the spring pin 13, a worker may rotate the fixing ring 40 easily without causing any impact or damage. In other words, by means of the spring pin 13, the connectors 1, 2 may be compressed to each other in a soft and smooth way.

As described above, in the present disclosure, the connectors 1, 2 may be coupled in a genderless way without male and female classification in order to connect adjacent modules 1*a*, 2*a*. In other words, by coupling two connectors having the same configuration to each other regardless of connection orientations and connection directions of modules, the modules may be coupled very easily.

Here, it is already described that two connectors 1, 2 can be coupled at any coupling orientations with a relative orientation interval of 90° (see FIG. 1).

Figure 8A:
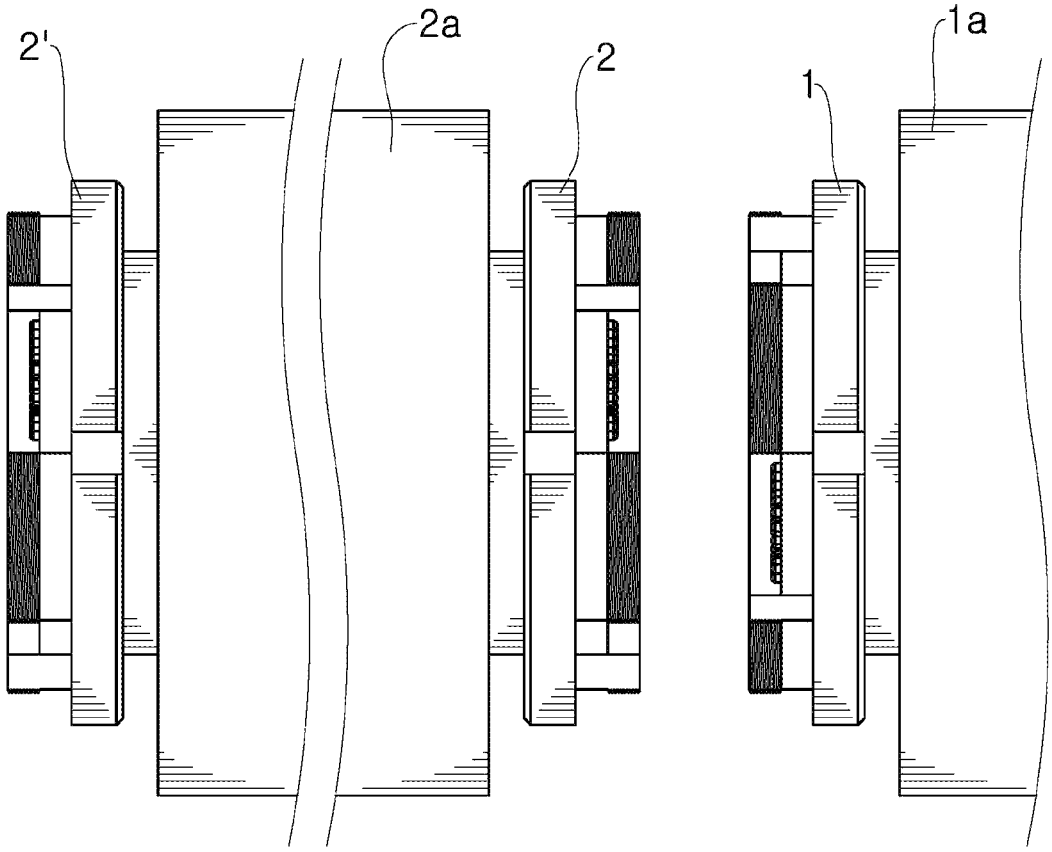
FIGS. 8A and 8B are diagrams for illustrating connection orientation of the connector.
Figure 8B:
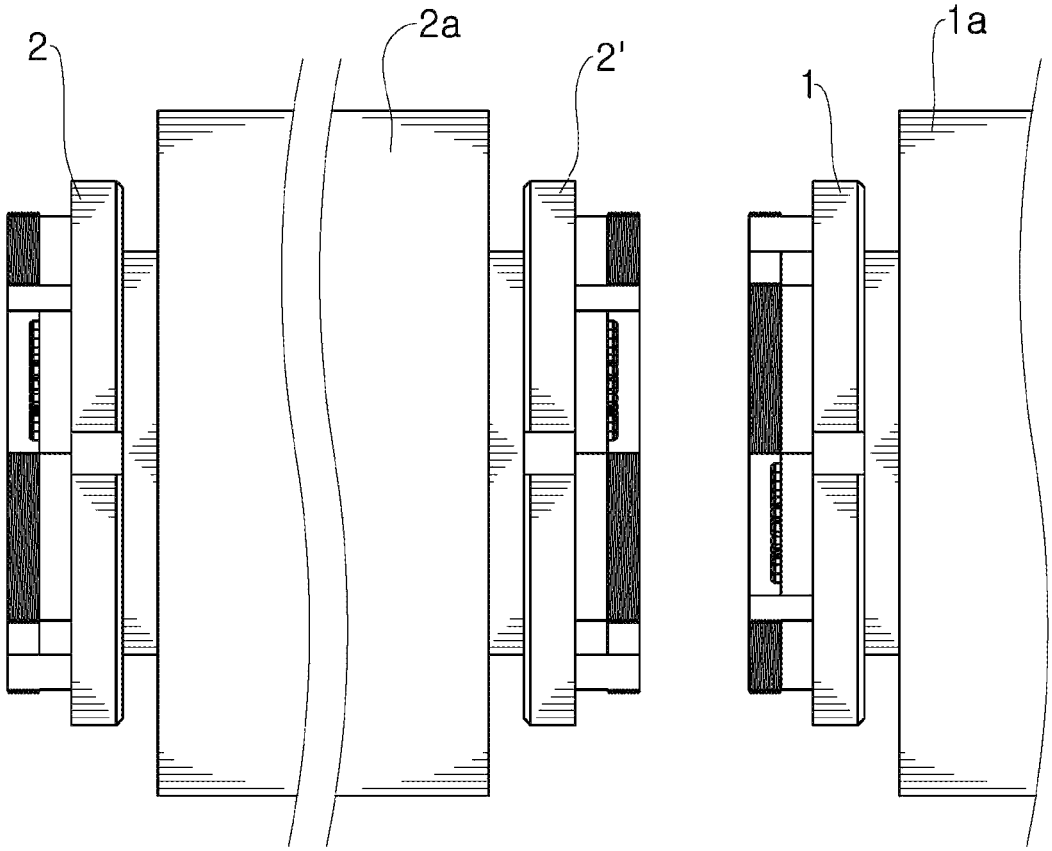

FIGS. 8A and 8B are diagrams for illustrating connection orientation of the connector.

As shown in FIGS. 8A and 8B, for example, if connectors 2, 2' having the same configuration are provided at both ends of a second module 2*a*, the second module 2*a* may be connected to a first module 1*a* in any connection directions.

The module connection mechanism according to the embodiment of the present disclosure can sufficiently satisfy the demands of the market in the robot technology fields, which is shifted from the existing supplier-oriented market into a user-oriented market, in the module connection mechanism fields.

What is claimed is:

1. A module connection mechanism for coupling adjacent modules, comprising: a connector for connecting the modules wherein the connector includes:

a substrate having a plurality of terminals for transmitting power and signals, installed between the modules;

a fixing body disposed to surround the substrate and having a fixing wing with a wing thread formed at an outer surface thereof; and a fixing ring disposed to surround the fixing body and having a ring thread formed at an inner surface thereof, so that the ring thread moves to cover an outer surface of the fixing body.

2. The module connection mechanism according to claim 1, wherein the fixing wing includes:

a first part attached to the fixing body; and a second part having an outer surface at which the wing thread is formed.

3. The module connection mechanism according to claim 1, wherein the module connection mechanism includes:

a first connector fixed to one side of a first module; and a second connector having the same configuration as the first connector and fixed to one side of the second module.

4. The module connection mechanism according to claim 3, wherein the first connector and the second connector are coupled to each other by coupling a ring thread of the first connector to a wing thread of the second connector by means of rotation and coupling a ring thread of the second connector to a wing thread of the first connector by means of rotation.

5. The module connection mechanism according to claim 3, wherein a power supplier, a signal transmitter and a ground are provided at the substrate in order from a center thereof to an outer side.

6. The module connection mechanism according to claim 5, wherein terminals for transmitting signals to the power supplier, the signal transmitter and the ground and spring pins having a predetermined elastic force are installed at the substrate in a fan shape.

7. The module connection mechanism according to claim 6, wherein the terminals and the spring pins configure a terminal group and a spring pin group concentrated in a fan shape of 45°, and the terminal group and the spring pin group are provided in plural inside the substrate, and wherein two sets of the spring pin groups are provided to be disposed symmetric based on a single point, and a plurality of spring pins are installed to the power supplier, the signal transmitter and the ground in one of the two sets.

8. The module connection mechanism according to claim 6, wherein among the terminals and the spring pins, spring pins other than a positioning pin for detecting an initial coupling location are disposed to be symmetric based on a single point on the substrate.

9. The module connection mechanism according to claim 8, wherein the positioning pin includes a first positioning pin disposed relatively at an outer side of the ground and a second positioning pin disposed opposite to the first positioning pin based on a single point and disposed relatively at an inner side of the ground in comparison to the first positioning pin, and wherein initial coupling locations of the first connector and the second connector are detectable at intervals of 90° by means of the first positioning pin and the second positioning pin.

10. The module connection mechanism according to claim 1, wherein a recess having an inwardly concave shape is formed at an outer surface of the fixing ring.

* * * * *